US010189279B2

(12) United States Patent
Ishizuka

(10) Patent No.: US 10,189,279 B2
(45) Date of Patent: Jan. 29, 2019

(54) LIQUID DISCHARGE APPARATUS AND MEDIUM FLATTENING METHOD

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/797,226

(22) Filed: Oct. 30, 2017

(65) Prior Publication Data

US 2018/0050547 A1 Feb. 22, 2018

Related U.S. Application Data

(62) Division of application No. 15/181,746, filed on Jun. 14, 2016, now Pat. No. 9,834,011, which is a division
(Continued)

(30) Foreign Application Priority Data

Feb. 25, 2014 (JP) ..... 2014-034337

(51) Int. Cl.
*B41J 11/00* (2006.01)
*B65H 23/34* (2006.01)
(Continued)

(52) U.S. Cl.
CPC ..... *B41J 11/0005* (2013.01); *B41J 3/407* (2013.01); *B41J 3/4078* (2013.01);
(Continued)

(58) Field of Classification Search
CPC ..... B65H 23/34; B41J 11/0005
See application file for complete search history.

(56) References Cited

U.S. PATENT DOCUMENTS 3,763,776 A * 10/1973 Jaffa ..... B41F 15/20 101/126
3,971,696 A * 7/1976 Manfredi ..... B65H 23/34 162/271
(Continued)

FOREIGN PATENT DOCUMENTS

JP 05-212851 A 8/1993
JP 09-239968 A 9/1997
(Continued)

OTHER PUBLICATIONS

The extended European search report for the corresponding European Patent Application No. 15156597.5 dated Aug. 10, 2015.

*Primary Examiner* — Shelby L Fidler

(57) ABSTRACT

A medium flattening method, when a medium is transported by being adhered to an adhesive layer which is on a surface of a transport belt, includes detecting a presence or absence of floating being generated in the medium on the transport belt using a sensor, executing a process for flattening to flatten the floating in the medium in the case where the floating exists, and transporting the medium, where the floating is eliminated using the process for the flattening, to a liquid discharge region of a liquid discharge section. The executing of the process for the flattening includes executing the process for the flattening with regard to the medium and liquid discharge with regard to the medium in parallel.

1 Claim, 9 Drawing Sheets

Related U.S. Application Data of application No. 14/602,382, filed on Jan. 22, 2015, now Pat. No. 9,393,806.

(51) Int. Cl.

| | |
|---|---|
| ***B41J 15/04*** | (2006.01) |
| ***B41J 3/407*** | (2006.01) |
| ***B65H 5/36*** | (2006.01) |

(52) U.S. Cl.

CPC ..... *B41J 11/0095* (2013.01); *B41J 15/048* (2013.01); *B65H 5/36* (2013.01); *B65H 23/34* (2013.01); *B65H 2301/51232* (2013.01); *B65H 2404/1521* (2013.01); *B65H 2404/256* (2013.01); *B65H 2404/261* (2013.01); *B65H 2553/412* (2013.01); *B65H 2801/15* (2013.01)

(56) References Cited

U.S. PATENT DOCUMENTS

| | | | | |
|---|---|---|---|---|
| 5,541,626 | A | 7/1996 | Hiramatsu et al. | |
| 8,267,509 | B2 | 9/2012 | Sakano | |
| 2002/0101492 | A1 | 8/2002 | Hierro et al. | |
| 2004/0179077 | A1 | 9/2004 | Sami et al. | |
| 2005/0242496 | A1 | 11/2005 | Dutoit et al. | |
| 2006/0280544 | A1* | 12/2006 | Holzer | B41J 3/28 400/630 |
| 2009/0167833 | A1 | 7/2009 | Mochizuki | |
| 2012/0062638 | A1 | 3/2012 | Toya | |
| 2012/0201590 | A1 | 8/2012 | Moore et al. | |
| 2012/0224012 | A1* | 9/2012 | Inoue | B41J 13/226 347/104 |
| 2013/0038656 | A1 | 2/2013 | Mizutani | |
| 2013/0074713 | A1* | 3/2013 | Lai | B65H 23/34 100/176 |
| 2014/0292969 | A1* | 10/2014 | Tanaka | B41J 13/0009 347/102 |
| 2015/0054875 | A1* | 2/2015 | Hayafuchi | B41J 3/4078 347/14 |

FOREIGN PATENT DOCUMENTS

| | | | |
|---|---|---|---|
| JP | 2010-242229 | A | 10/2010 |
| JP | 2013-019083 | A | 1/2013 |
| JP | 2013-023771 | A | 2/2013 |
| JP | 2013-188899 | A | 9/2013 |

* cited by examiner

LIQUID DISCHARGE APPARATUS AND MEDIUM FLATTENING METHOD

CROSS-REFERENCE TO RELATED APPLICATIONS

This application is a divisional application of U.S. patent application Ser. No. 15/181,746 filed on Jun. 14, 2016, which is a divisional application of U.S. patent application Ser. No. 14/602,382 filed on Jan. 22, 2015. This application claims priority to Japanese Patent Application No. 2014-034337 filed on Feb. 25, 2014. The entire disclosures of U.S. patent application Ser. Nos. 15/181,746 and 14/602,382 and Japanese Patent Application No. 2014-034337 are hereby incorporated herein by reference.

BACKGROUND

Technical Field

The present invention relates to a liquid discharge apparatus with a configuration where a medium is transported by being adhered to a transport belt where there is an adhesive layer on a surface of the transport belt and a medium flattening method which is executed in a case where the liquid discharge apparatus is used.

Related Art

Screen printing apparatuses and roller printing apparatuses, where plates are prepared for each color in a pattern to be printed, are widely used in the prior art as an apparatus which performs printing on fabric such as cotton, silk, or polyester. In addition, ink jet recording apparatuses which are able to cope with small scale production of many types of products have rapidly come into widespread use corresponding to digitalization in recent years since it is possible to carry out plateless printing on fabric.

There are such ink jet recording apparatuses with a configuration where a medium is transported by being adhered to the transport belt where there is the adhesive layer on a surface of the transport belt as shown in Japanese Unexamined Patent Application Publication No. 2010-242229.

In addition, there are cases where fabric is used as the medium which is used with such ink jet recording apparatuses, and there are cases where a plurality of sheets of fabric are used by being joined together. Then, the thickness of a join in these sheets of fabric which are joined together becomes thick and it is not possible to expect favorable recording at the join.

A recording apparatus according to Japanese Unexamined Patent Application Publication No. H5-212851 is provided with a detecting apparatus which detects the joins in the fabric and carries out controlling such that the medium is empty fed and passed through without a recording executing section being driven when a join is detected by the detecting apparatus.

In addition, it is easy for sagging and wrinkling to be generated since fabric stretches and contracts.

Accordingly, there are cases where curling, twisting, wrinkling, and the like are possible during transporting even without floating such as curling, twisting, and wrinkling being generated in a case where the fabric is adhered onto the transport belt.

Then, in this case, transporting of the transport belt is temporarily stopped and floating such as curling, twisting, and wrinkling are manually eliminated by an operator.

However, it is not efficient for an operator to manually eliminate floating in the medium by stopping driving of the transport belt every time floating is generated in the medium, and there is a substantial effect on productivity at a workplace where recording is performed continuously with regard to a medium with long dimensions.

In addition, the description in Japanese Unexamined Patent Application Publication No. H5-212851 is limited to performing of controlling so that joins in the medium are detected and discharging is not performed with regard to the joins which are detected and the joins are passed over, and a mechanism in order to eliminate floating in the medium is neither described nor suggested in Japanese Unexamined Patent Application Publication No. H5-212851.

SUMMARY

The object of the present invention is to automatically eliminate the floating in a medium by detecting the floating in a case where floating such as curling is generated in the medium during executing of liquid discharge in a liquid discharge apparatus with a configuration where the medium is transported by being adhered to a transport belt where there is an adhesive layer on a surface of the transport belt.

According to one aspect of the invention, a medium flattening method, when a medium is transported by being adhered to an adhesive layer which is on a surface of a transport belt, comprises detecting a presence or absence of floating being generated in the medium on the transport belt using a sensor, executing a process for flattening to flatten the floating in the medium in the case where the floating exists, and transporting the medium, where the floating is eliminated using the process for the flattening, to a liquid discharge region of a liquid discharge section. The executing of the process for the flattening includes executing the process for the flattening with regard to the medium and liquid discharge with regard to the medium in parallel.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
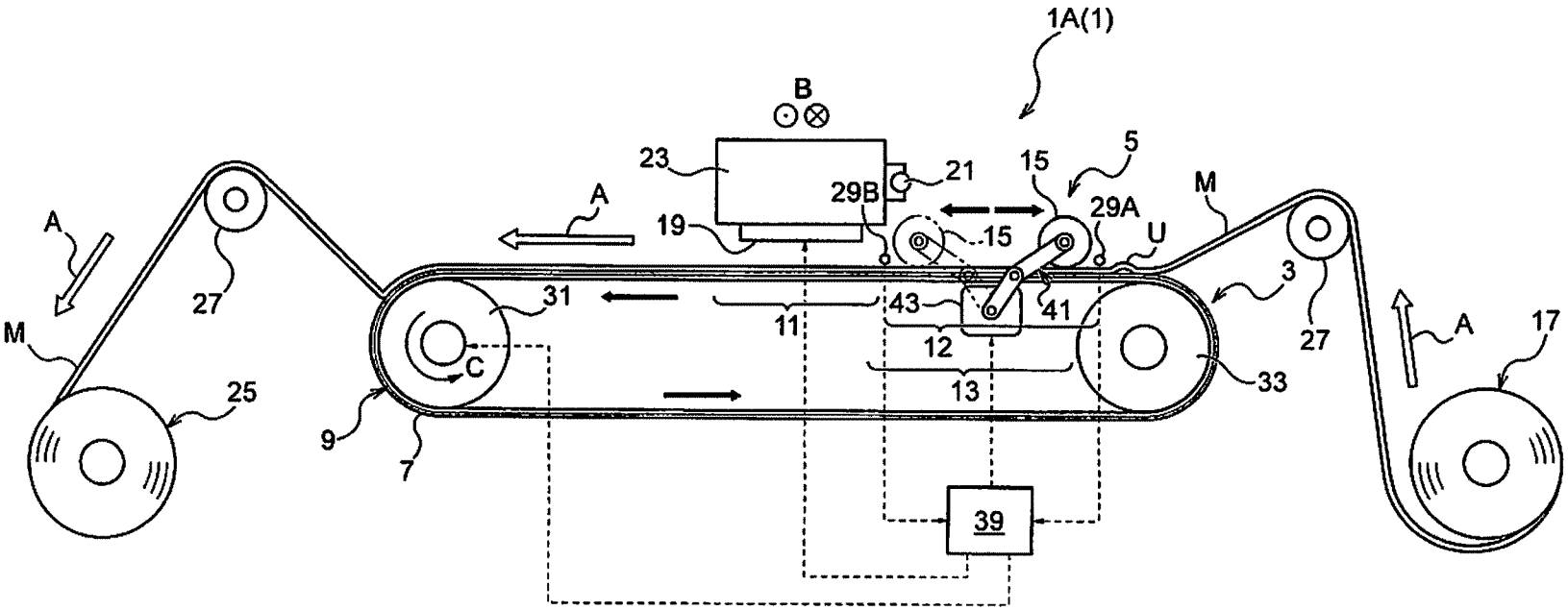
FIG. 1 is a side surface diagram representing an outline of a liquid discharge apparatus according to embodiment 1 of the present invention.

A liquid discharge apparatus and a medium flattening method of the present invention will be described below in detail with reference to the attached drawings.

In the following description, an outline configuration of the liquid discharge apparatus of the present invention and the detailed configuration and operational aspects of a sensor, a flattening section, and a control section which are the characteristic configurations of the present invention will be described based on embodiment 1 to begin with the six embodiments of embodiments 1 to 6 as examples. Next, the configuration and operational aspects of a liquid discharge apparatus according to embodiment 2 and the configuration and operational aspects of a liquid discharge apparatus according to embodiment 3 will be described in order centered on the differences to embodiment 1.

Furthermore, after methods for flattening a medium according to embodiments 4 to 6 are described in order, various aspects where the configuration of the flattening section is different will be referred to as other embodiments last of all.

Figure 2:
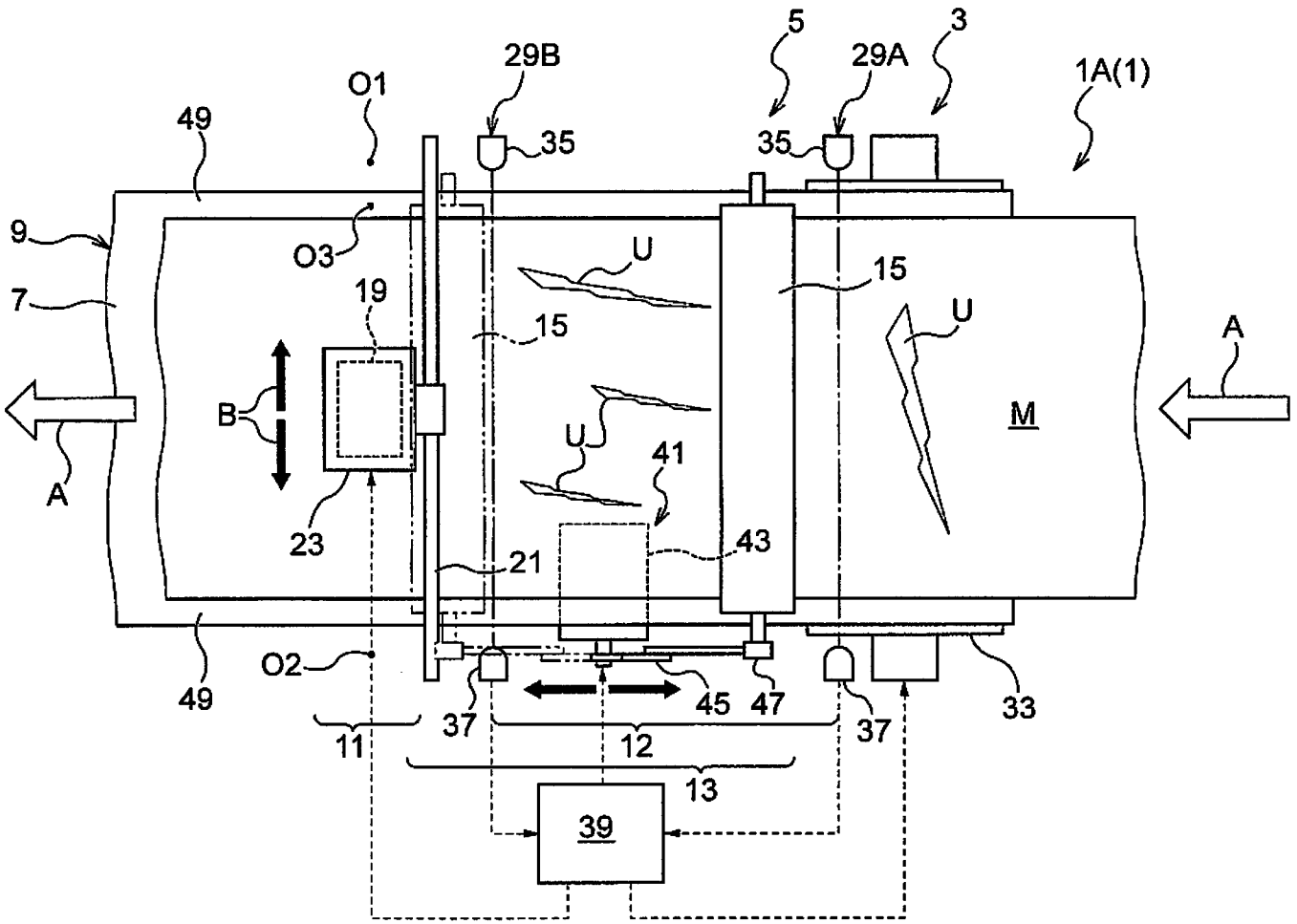
FIG. 2 is a planar surface diagram representing an outline of a liquid discharge apparatus according to embodiment 1 of the present invention.
Figure 3:
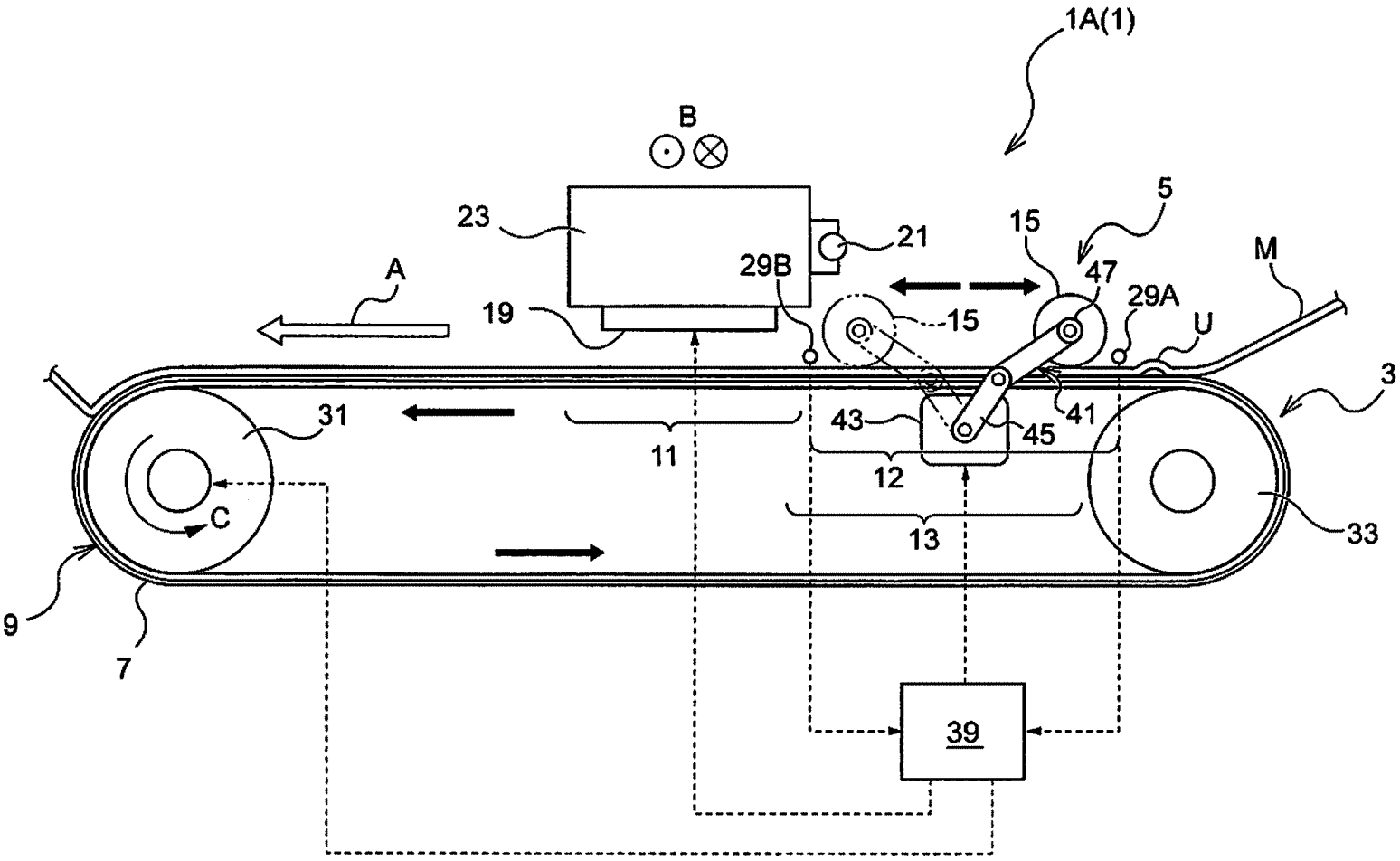
FIG. 3 is an enlarged side surface diagram representing a main section of a liquid discharge apparatus according to embodiment 1 of the present invention.

Embodiment 1 (Refer to FIG. 1 to FIG. 3)

A liquid discharge apparatus 1 of embodiment 1 according to the present invention is provided with a medium transport section 3 which is provided with a transport belt 9, where a medium M is transported by being adhered an adhesive layer 7 which is on a surface of the transport belt 9, a liquid discharge section (also referred to below as a "liquid discharge head") 19, where it is possible to discharge a liquid toward a surface of the transport belt 9, a sensor 29 which detects the presence or absence of floating U such as curling being generated in the medium M on the transport belt 9, a flattening section 5 which is for carrying out an action of flattening with regard to the medium M on the transport belt 9, and a control section 39 which controls the operations of the flattening section 5 based on detecting information from the sensor 29.

Here, the floating U has the meaning of a portion, which rises up more than the surface due to curling, twisting, wrinkling, or the like, in the medium M which is stuck to the surface of the transport belt 9.

Then, in embodiment 1, a pressure roller 15, which is used when adhering the medium M to the adhesive layer 7 of the transport belt 9, is adopted as the flattening section 5. The process for flattening is executed by the pressure roller 15 by being configured to be able to move along a transport direction A of the medium M.

(1) Outline Configuration of Entire Liquid Discharge Apparatus (Refer to FIG. 1 and FIG. 2)

To begin with, an outline configuration of a liquid discharge apparatus 1A according to embodiment 1 will be described based on FIG. 1 and FIG. 2.

The liquid discharge apparatus 1A shown in FIG. 1 is an ink jet recording apparatus which uses fabric as the medium M. Here, "fabric" is natural fibers such as cotton, hemp, and silk, synthetic fibers such as nylon and polyester, or a fiber product such as cloth or a woven material which is made from source materials which are a mixture of the natural fibers and the synthetic fibers.

In addition, a feeding section 17 which feeds the medium M which is wound in a roll shape by a predetermined amount at a time, a liquid discharge section 19 which executes recording by discharging ink, which is an example of a liquid, onto a target surface for liquid discharge on the medium M which is supplied to a liquid discharge region 11 which is a region where recording is executed, a carriage 23 which moves back and forth in a width direction B which intersects with the transport direction A of the medium M along a carriage guide shaft 21 in a state where, as an example, the liquid discharge section 19 is mounted onto the lower surface, a winding section 25 which winds in the medium M which is peeled away from the transport belt 9 after liquid discharge is executed, and a guide roller 27 which is provided at, as an example, a position which is downstream of the feeding section 17 and a position which is upstream of the winding section 25, are provided in the liquid discharge apparatus 1A along with the configuration members described above.

The medium transport section 3 is configured by being provided with the transport belt 9 with an endless belt shape which transports by circulating so as to pass through the liquid discharge region 11, a driving roller 31 which transfers driving force from the transport belt 9 in, as an example, a rotation direction C, and a driven roller 33 which is arranged to be separate with regard to the driving roller 31 and stretches and holds the transport belt 9 in a state where the transport belt 9 is wound around the driven roller 33 and the driving roller 31.

Here, in embodiment 1 in the drawings, the driving roller 31 is arranged, as an example, at a position which is downstream in the transport direction A of the medium M and the driven roller 33 is arranged, as an example, at a position which is upstream in the transport direction A of the medium M. In addition, the adhesive layer 7 described above for adhering the medium M is provided on a surface, which is the opposite side to the driving roller 33, of the transport belt 9 with an endless belt shape.

(2) Detailed Configurations and Operational Aspects of Sensor, Flattening Section, and Control Section (Refer to FIG. 1 to FIG. 3)

The sensor 29 is configured by, as an example, a contactless transmissive type of optical sensor which is configured by a light emitting section 35 and a light receiving section 37. Then, a floating checking region 12, where there is checking for the floating U such as curling in the medium M, is provided at a position which is upstream of the recording execution region 11 and two sets of sensors, sensors 29A and 29B, are provided, as an example, at a position which is upstream and a position which is downstream of the floating checking region 12 in embodiment 1.

That is, the sensor 29A, which is provided at a position which is upstream of the floating checking region 12, is a sensor for checking for floating where whether or not the floating U is generated is checked for in the medium M which is being transported, and the sensor 29B which is provided at a position which is downstream of the floating checking region 12 is a sensor for confirming whether or not the floating U which is generated in the medium M is eliminated by the flattening section 5 which is described next.

The flattening section 5 is basically configured to be provided with the pressure roller 15 described above and a horizontal movement mechanism 41 for moving the pressure roller 15 along the transport direction A of the medium M.

The horizontal movement mechanism 41 is configured to be provided with, as an example, a motor 43 which is a drive source, a swing converting mechanism, which is not shown in the drawings, which converts rotation of an output shaft of the motor 43 to a swing operation over the range of a certain angle, a swing arm 45 which swings by receiving motive force which is converted by the swing converting mechanism, and a bearing arm 47 which is a rotation support member for the pressure roller 15 which is provided at the free end of the swing arm 45.

In addition, the control section 39 in embodiment 1 controls the operations of the flattening section 5, the medium transport section 3 which is provided with the transport belt 9, the liquid discharge section 19 which discharges liquid onto the medium on the transport belt 9, and the carriage 23 based on detecting information which is obtained from the two sets of the sensors 29A and 29B described above.

In detail, the control section 39 executes a process for flattening using the flattening section 5 as first controlling in a state where the liquid discharge section 19 and the carriage 23 are moved to a retreat position O where operations of the flattening section 5 are not impeded when the floating U in the medium M is detected by the sensor 29A for checking.

Here, it is possible for a home position O1 of the carriage 23, a return position O2 which is in the opposite direction to the home position O1, or a flushing position O3 where flushing is performed in order to prevent clogging of the liquid discharge section 19 to be applied as examples of the retreat position O.

Among these, the flushing position O3 is provided on a side edge 49, where the medium M is not on the transport belt 9, of the transport belt 9 in the width direction B in the present embodiment.

In addition, a configuration is possible such that it is possible for the movement range of the pressure roller 15 to be variable. In a case where this configuration is adopted, controlling is possible as second controlling in the control section 39 so that the movement range of the pressure roller 15 is adjusted according to the position and size of the floating U which is generated in the medium M during transporting.

That is, a process for flattening the medium M, where there is no waste with only necessary portions being carried out, is possible and it is possible to achieve a shortening of the time which is necessary for the process for flattening in a case where the second controlling is adopted in this manner.

In addition, controlling is possible as third controlling in the control section 39 so that liquid discharge with regard to the medium M is stopped temporarily during executing of the process for flattening using the flattening section 5 and liquid discharge with regard to the medium M is restarted after the process for flattening using the flattening section 5 is executed.

That is, it is possible to separate the process for flattening the medium M and the process for executing liquid discharge with regard to the medium M and it is possible to precisely execute each of the processes without the processes being influenced by each other in a case where the third controlling is adopted in this manner. In addition, it is possible to prevent interference between the flattening section 5 during executing of the process for flattening and the liquid discharge section 19 and the carriage 23 which are the parts for executing liquid discharge and it is possible to improve productivity by quickly restarting liquid discharge after the process for flattening is executed.

Then, due to the liquid discharge apparatus 1A according to embodiment 1 which is configured in this manner, it is possible to automatically eliminate the floating U in the medium M by detecting the floating U and transition to executing of liquid discharge which is next in a case where the floating U such as curling is generated in the medium M during executing of liquid discharge in the liquid discharge apparatus which is provided with the medium transport section 3 where the medium M is transported by being adhered to the transport belt 9 where the adhesive layer 7 is formed on a surface of the transport belt 9.

In addition, it is possible to also execute controlling of the flattening section 5 and the like with high precision since it is possible to detect the floating U in the medium M with high precision by adopting an optical sensor with superior directivity which is provided with the light emitting section 35 and the light receiving section 37.

Figure 4:
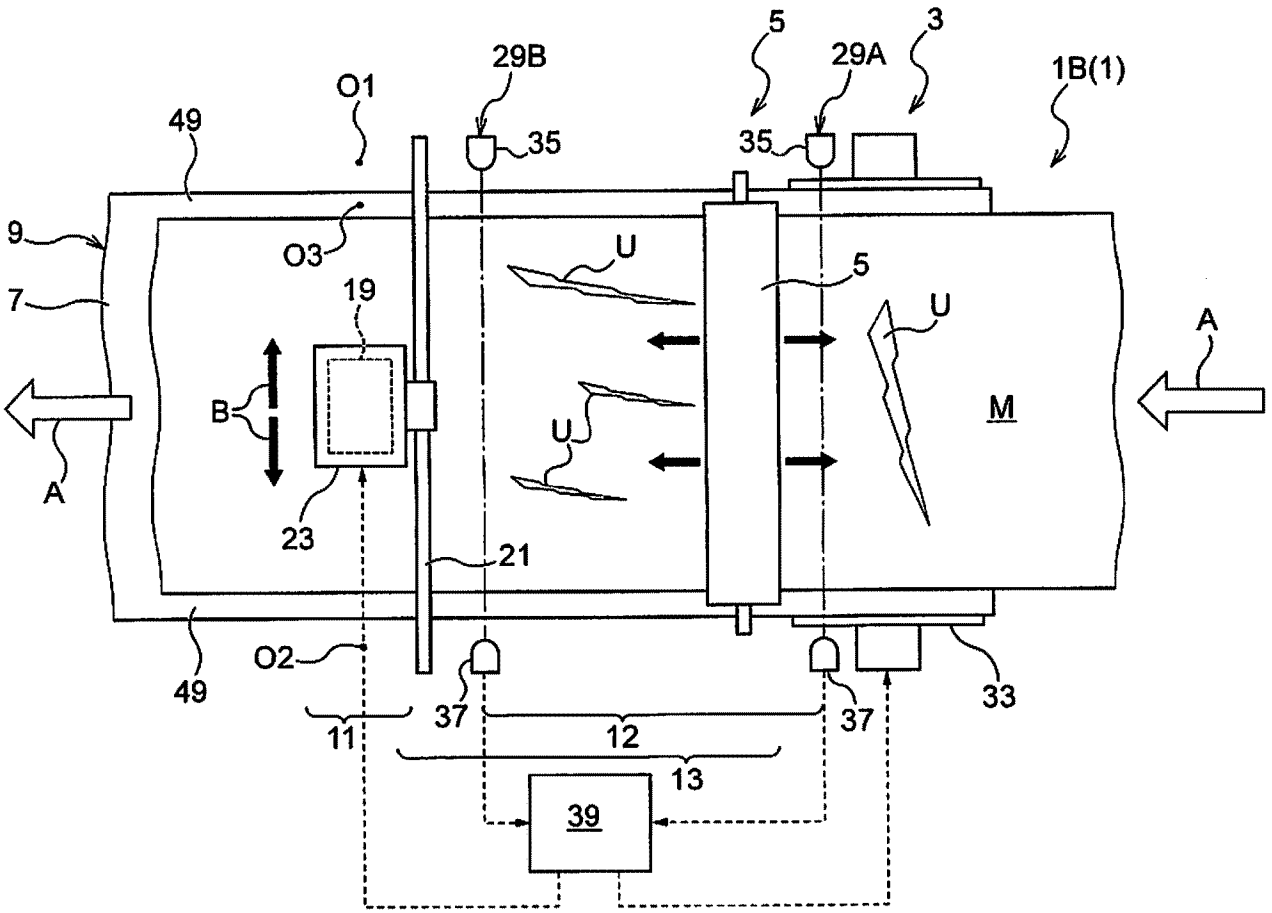
FIG. 4 is a planar surface diagram representing an outline of a liquid discharge apparatus according to embodiment 2 of the present invention.

Embodiment 2 (Refer to FIG. 4)

A liquid discharge apparatus 1B according to embodiment 2 is a liquid discharge apparatus where the position of the pressure roller 15, which is configured to be able to move along the transport direction A of the medium M in embodiment 1, is fixed and which executes the process for flattening in the same manner as is performed in embodiment 1 by the transport belt 9 being moved in the opposite direction to the transport direction A.

Here, other configurations are the same as the liquid discharge apparatus 1A according to embodiment 1 described above. Accordingly, description of the same configurations as embodiment 1 is omitted and the description is centered on configurations which are newly adopted in embodiment 2 and the actions and effects of these configurations.

That is, the horizontal movement mechanism 41 which is adopted in embodiment 1 is omitted in embodiment 2 and the same actions which are executed by the horizontal movement mechanism 41 are executed by the transport belt 9 being back fed in the opposite direction to the transport direction A of the medium M.

Then, it is possible to benefit from the same actions and effects as the liquid discharge apparatus 1A according to embodiment 1 described above even with the liquid discharge apparatus 1B according to embodiment 2 which is configured in this manner, and it is possible to provide the liquid discharge apparatus 1 which is compact due to the structure being simplified by the horizontal movement mechanism 41 being omitted in embodiment 2.

Figure 5:
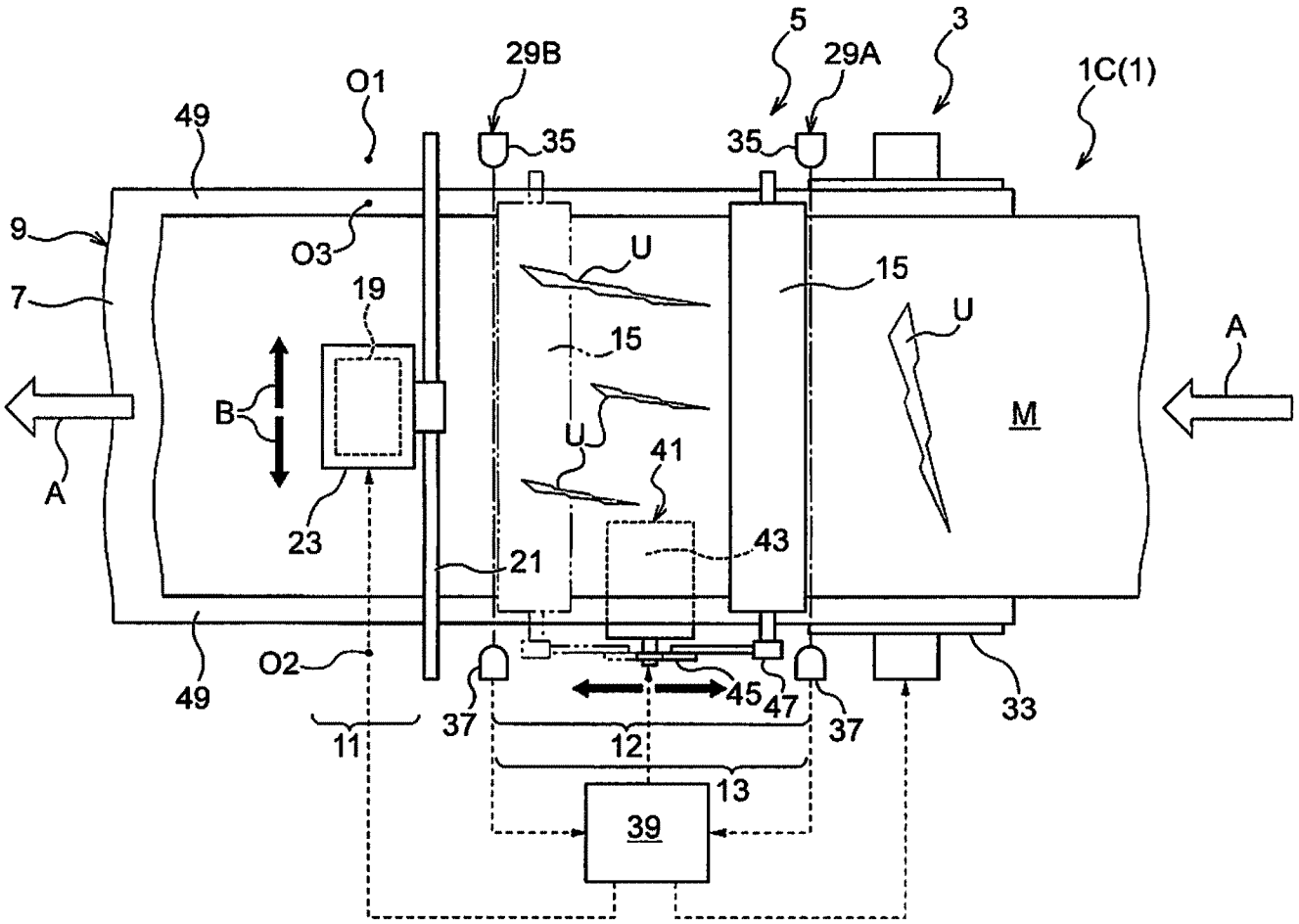
FIG. 5 is a planar surface diagram representing an outline of a liquid discharge apparatus according to embodiment 3 of the present invention.

Embodiment 3 (Refer to FIG. 5)

A liquid discharge apparatus 1C according to embodiment 3 is a liquid discharge apparatus where the liquid discharge region 11 and a flattening process region 13, which overlap in embodiment 1, are completely separate and it is possible to simultaneously execute the process for flattening and the process for liquid discharge.

Here, other configurations are the same as the liquid discharge apparatus 1A according to embodiment 1 described above. Accordingly, description of the same configurations as embodiment 1 is omitted and the description is centered on configurations which are newly adopted in embodiment 3 and the actions and effects of these configurations.

That is, the flattening process region 13, where the process for flattening is performed, is provided in embodiment 3 in a range which is substantially the same as the floating checking region 12 which is at a position which is upstream of the liquid discharge region 11 of the medium transport section 3.

Then, controlling is performed where the process of flattening with regard to the medium M using the flattening section 5 and liquid discharge with regard to the medium M are executed in parallel by the control section 39.

Then, it is possible to benefit from the actions and effects which are the same as the liquid discharge apparatus 1A according to embodiment 1 described above even with the liquid discharge apparatus 1C according to embodiment 3 which is configured in this manner.

Furthermore, it is possible to achieve a further improvement in productivity in embodiment 3 since it is possible to continuously execute liquid discharge while the process for flattening, where the floating U in the medium M is eliminated, is performed without temporarily stopping executing of liquid discharge even in a case where the floating U is generated in the medium M.

Figure 6:
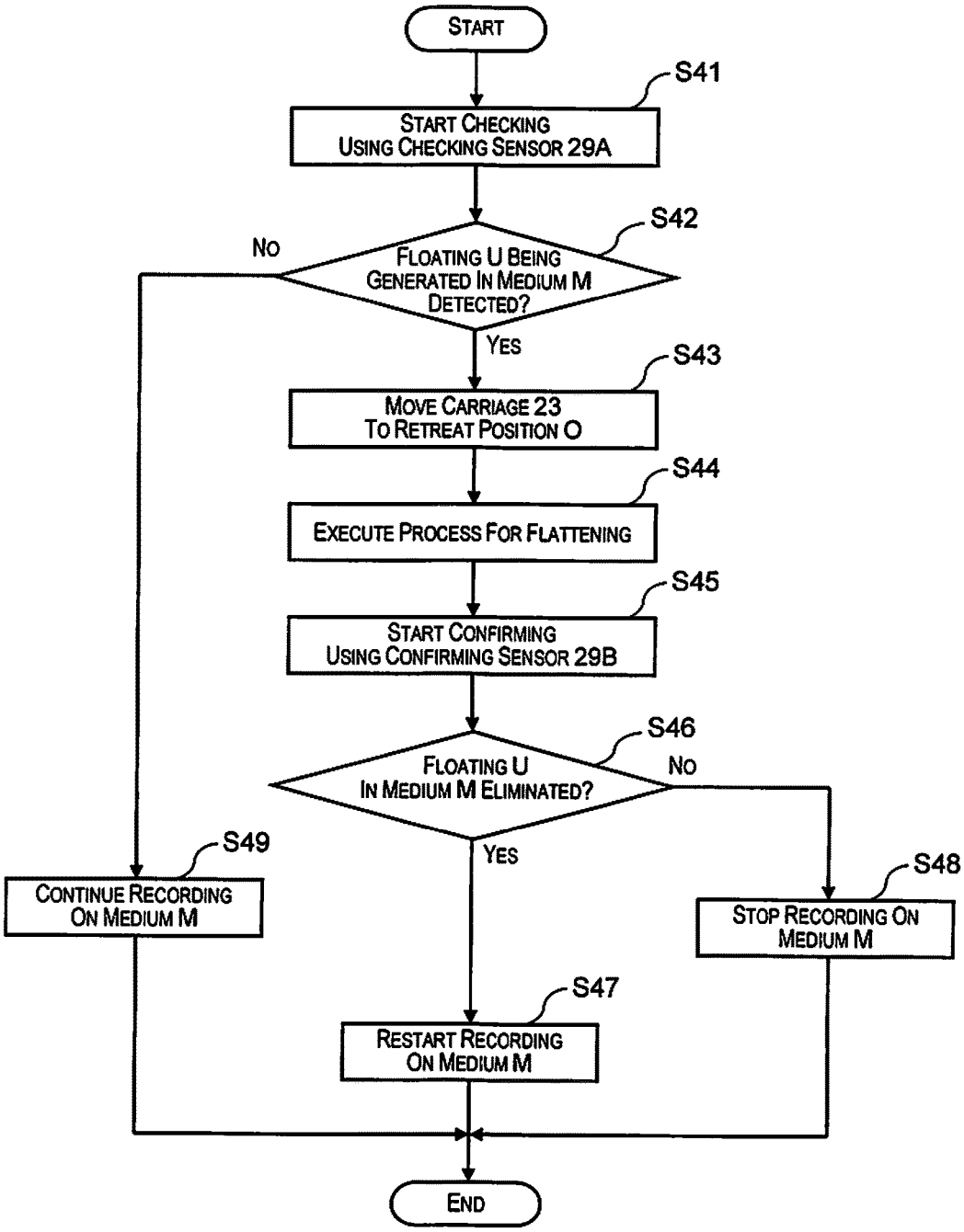
FIG. 6 is a flow chart representing a medium flattening method according to embodiment 4 of the present invention.

Embodiment 4 (Refer to FIG. 6)

In a medium flattening method in embodiment 4 according to the present invention, the process for flattening where the floating U in the medium M is flattened is executed in a case where the floating U such as curling is generated in the medium M when the medium M is transported in a state of being adhered to the transport belt 9 where there is the adhesive layer 7 on a surface of the transport belt 9 and the medium M where the floating U is eliminated by the process for flattening is transported to the liquid discharge region 11.

Then, the medium flattening method, which is executed in a case where the liquid discharge apparatus 1A according to embodiment 1 described above is used, is disclosed in embodiment 4 and the medium flattening method is configured such that processes are executed according to the flow of the flow chart shown in FIG. 6 as an example.

First, the sensor 29A for checking, which is provided at a position which is upstream of the floating checking region 12, is activated and checking of the presence or absence of the floating U being generated in the medium M starts in step S41. Next, the process transitions to step S42, determining of whether or not the floating U being generated in the medium M is detected is performed, and the carriage 23 is moved to the retreat position O by the process transitioning to step S43 in a case where it is determined that the floating U being generated in the medium M is confirmed.

Next, the process transitions to step S44 and the process for flattening is executed due to the flattening section 5 being driven. After the process for flattening is executed, the process transitions to step S45, the sensor 29B for confirming is activated, and confirming of whether or not the floating U in the medium M is eliminated is started. Furthermore, the process transitions to step S46 and determining of whether or not the floating U in the medium M is eliminated is executed in step S46.

In a case where it is determined that the floating U in the medium M is eliminated, the process transitions to step S47 and liquid discharge onto the medium M is restarted, that is, recording onto the medium M is restarted.

In addition, in a case where it is determined that the floating U being generated in the medium M is not detected in step S42, the process transitions directly to step S49 and liquid discharge onto the medium M is continued.

In addition, in a case where it is determined that the floating U in the medium M is not eliminated in step S46, the process advances to step S48, the liquid discharge onto the medium M is temporarily stopped, and the process ends. In this case, liquid discharge is restarted after, for example, the floating U in the medium M is eliminated through a manual operation.

Then, according to the medium flattening method according to embodiment 4 which is configured in this manner, it is possible to prevent interference between the flattening section 5 and the liquid discharge section during executing of the process for flattening and it is possible to improve productivity by quickly restarting liquid discharge after the process for flattening is executed.

In addition, it is possible to precisely execute each of the processes without the processes being influenced by each other by separating the process for flattening the medium M and the process for executing liquid discharge with regard to the medium M.

Figure 7:
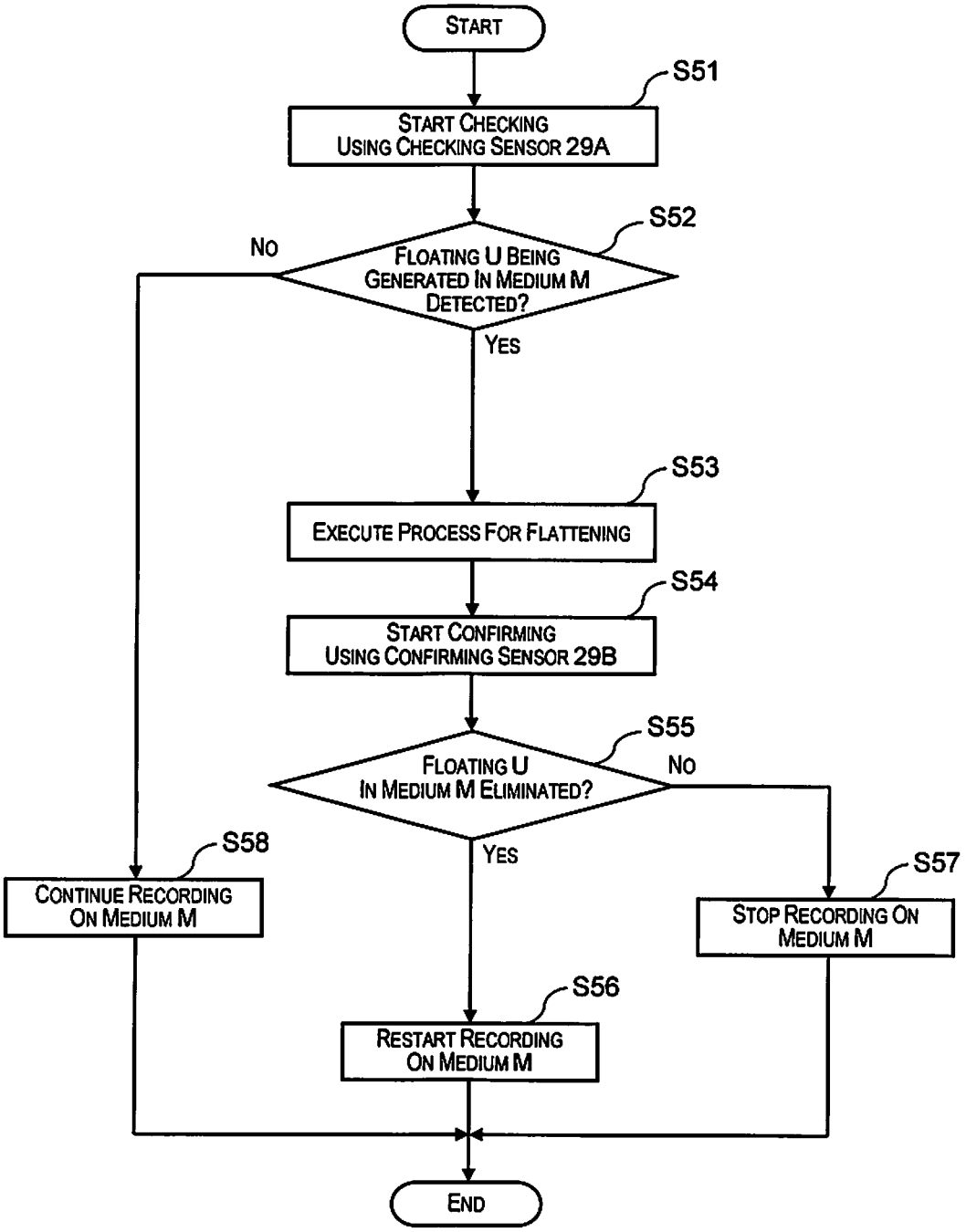
FIG. 7 is a flow chart representing a medium flattening method according to embodiment 5 of the present invention.

Embodiment 5 (Refer to FIG. 7)

A medium flattening method, which is executed in a case where the liquid discharge apparatus 1C according to embodiment 3 described above is used, is disclosed in embodiment 5 and the medium flattening method is configured such that the processes are executed according to the flow of the flow chart illustrated in FIG. 7 as an example.

In detail, embodiment 5 is configured by eight steps of step S51 to step S58 shown in FIG. 7 where step S43, shown in FIG. 6 in embodiment 4, is omitted. That is, the carriage 23 is moved to the retreat position O and the process of returning from the retreat position O to the liquid discharge position is not necessary since the process for flattening is performed in parallel without liquid discharge being temporarily stopped in embodiment 5.

Then, it is possible to benefit from the same actions and effects as embodiment 4 even with the medium flattening method according to embodiment 5 which is configured in this manner, and furthermore, it is possible to efficiently execute the process for flattening the medium M and liquid discharge with regard to the medium M without the processes being interrupted by each other in embodiment 5.

Accordingly, it is possible to achieve a further improvement in productivity in a case where, for example, liquid discharge is executed continuously over a long period of time with regard to the medium M with long dimensions.

Figure 8:
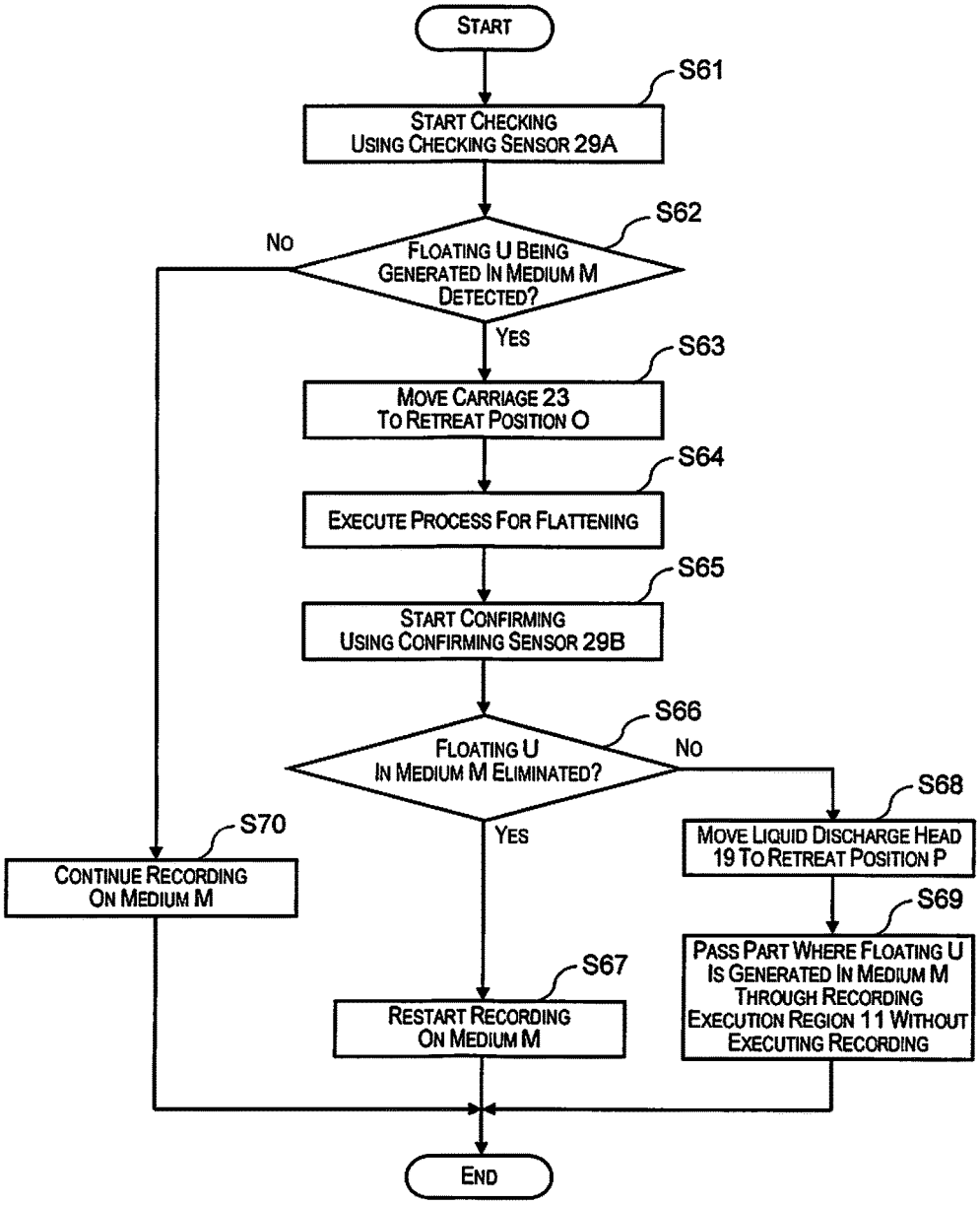
FIG. 8 is a flow chart representing a medium flattening method according to embodiment 6 of the present invention.

Embodiment 6 (Refer to FIG. 8)

A medium flattening method, which is executed in a case where the liquid discharge apparatus 1A according to embodiment 1 described above is used, is disclosed in embodiment 6 and the medium flattening method is configured such that the processes are executed according to the flow of the flow chart illustrated in FIG. 8 as an example.

In detail, embodiment 6 is configured by ten steps of step S61 to step S70 where the process of step S48 shown in FIG. 6 in embodiment 4 is replaced with the processes of step S68 and step S69 shown in FIG. 8.

That is, the process when it is determined that the floating U in the medium M is not eliminated in step S66 in FIG. 8 is different to embodiment 4, and in this case, the process transitions to step S68 and the liquid discharge section (liquid discharge head) 19 is moved to a retreat position P.

Here, it is possible for the liquid discharge section 19 to be moved to the retreat position P using this configuration according to the liquid discharge apparatus which is provided with a configuration where it is possible to adjust a gap between a nozzle surface of the liquid discharge section 19 and the surface of the transport belt 9 since it is sufficient for the retreat position P to be set to an extent such that a portion, where the floating U is generated in the medium M, does not come into contact with the nozzle surface which is at a lower surface of the liquid discharge section 19.

Next, the process transitions to step S69 and the liquid discharge region (the recording execution region) 11 is passed through without liquid discharge being executed on a part where the floating U is generated in the medium M. Then, liquid discharge (recording) is automatically restarted with regard to a portion where the floating U is not in the medium M after the part where the floating U is generated passes through the liquid discharge region 11.

The process described here is executed in the control section 39 described in embodiment 1 and is executed as the fourth controlling in place of the third controlling of the control section 39.

Then, it is possible to benefit from the same actions and effects as embodiment 4 even with the medium flattening method according to embodiment 6 which is configured in this manner.

In embodiment 4 where liquid discharge is temporarily stopped in a case where the floating U in the medium M is not eliminated, it is necessary to interrupt automation of liquid discharge onto the medium M but automation of liquid discharge without human input is possible since the liquid discharge onto the medium M in embodiment 6 is continuous.

Other Embodiments

The liquid discharge apparatus 1 and the methods for flattening a medium according to the present invention are based on having the configurations as described above, but it is obvious that it is also possible to perform modifications, omissions, and the like of partial configurations within a range which does not deviate from the gist of the present invention.

For example, instead of using the preexisting pressure roller 15 as a member which directly performs the process for flattening in the flattening section 5, a separate dedicated roller may be used or a blowing apparatus which flattens by blowing an air flow onto the floating U may be used.

Figure 9A:
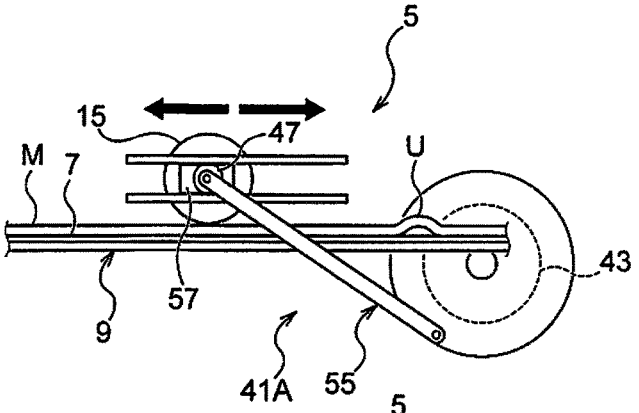
FIGS. 9A to 9D are explanatory diagrams representing various aspects of flattening sections of a liquid discharge apparatus according to other embodiments of the present invention.
Figure 9B:
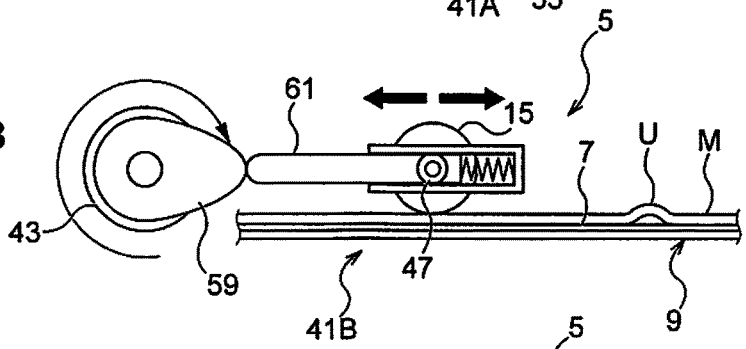
Figure 9C:
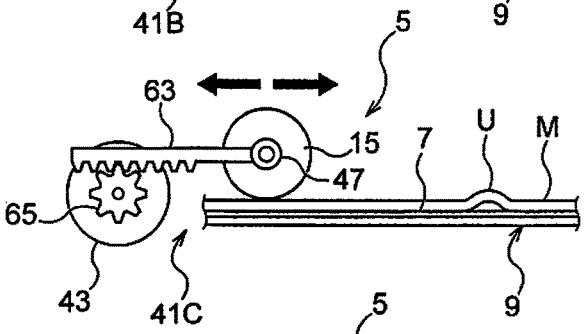
Figure 9D:
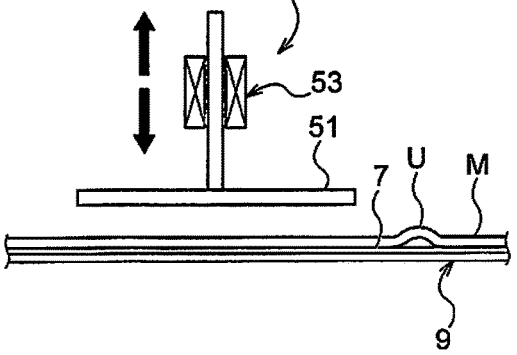

In addition, a pressing plate 51 as shown in FIG. 9D or the like may be used. That is, a vertical movement mechanism 53, which moves the pressing plate 51 in the up and down direction, is adopted in FIG. 9D in place of the horizontal movement mechanism 41 of the flattening section 5, and the process for flattening the medium M is performed so that the medium M is pressed down or hit from above by the pressing plate 51.

In addition, a horizontal movement mechanism 41A where a mechanism where a crank 55 and a piston 57 are used is adopted as shown in FIG. 9A, a horizontal movement mechanism 41B where a mechanism where a cam 59 and a cam follower 61 are used is adopted as shown in FIG. 9B, or a horizontal movement mechanism 41C where a mechanism where a rack 63 and a pinion 65 are used is adopted as shown in FIG. 9C may be used as the horizontal movement mechanism 41 of the flattening section 5.

Other than this, more sets of the sensors 29 which detect the floating U in the medium M may be provided instead of two sets being provided, or only one set may be provided.

In addition, it is possible to apply the present invention with regard to a liquid discharge apparatus where the carriage 23 is not provided and a so-called line head is provided as the liquid discharge section 19. Here, the "line head" is where nozzle rows are formed along the width direction B which intersects with the transport direction A of the medium M.

Here, the present invention is not limited to the applied examples described above, various modifications are possible within the scope of the invention described in the scope of the claims, and it is obvious that these various modifications are included in the scope of the present invention.

Above, the present invention is described in detail based on detailed applied examples. Here, a summary of the present invention will be described again.

The liquid discharge apparatus of the first aspect of the present invention is provided with the transport belt where the medium is transported by being adhered to the adhesive layer which is on a surface of the transport belt, the liquid discharge section where it is possible to discharge the liquid toward a surface of the transport belt, the sensor which detects the presence or absence of floating being generated in the medium on the transport belt, the flattening section which is for carrying out an action of flattening with regard to the medium on the transport belt, and the control section which controls the operations of the flattening section based on detecting information from the sensor.

Here, "floating" has the meaning of a portion, which rises up more than the surface due to curling, twisting, wrinkling, or the like, in the medium which is stuck to the surface of the transport belt.

"Flattening section" has the meaning of a section for carrying out an action of flattening in order to eliminate floating such a section which flattens the floating by pressing using a roller or a blowing apparatus which flattens by blowing an air flow on the floating.

According to the present aspect, it is possible to carry out a process for flattening with regard to the medium on the transport belt by operating the flattening section in a case where the sensor detects that there is floating since there is provided the control section which controls the operations of the flattening section based on detecting information from the sensor. Due to this, it is possible to automatically eliminate floating in a case where floating is generated in a medium during transporting, it is possible for liquid discharge with regard to the medium to be continuous, and it is possible to improve productivity.

The liquid discharge apparatus of the second aspect of the present invention is the first aspect which is provided with the pressure roller which adheres the medium to the adhesive layer of the transport belt, and the pressure roller also serves as the flattening section by being configured to be able to move along the transport direction of the medium.

According to the present aspect, it is possible to perform the process for flattening the medium using the pressure roller which is used when the medium is adhered to the adhesive layer of the transport belt since the pressure roller also serves as the flattening section by being configured to be able to move along the transport direction of the medium. It is possible to provide the liquid discharge apparatus with a compact structure without increasing the number of components.

In addition, it is possible to press a portion where floating is generated in the medium on the transport belt side using pressing force from the pressure roller with regard to the medium and to eliminate floating in the medium in this state due to the pressure roller being able to move along the transport direction of the medium.

The liquid discharge apparatus of the third aspect of the present invention is the second aspect where the movement range of the pressure roller is variable, and the control section performs controlling where the movement range of the pressure roller is adjusted according to the position of the floating which is detected by the sensor.

According to the present aspect, it is possible to efficiently move the pressure roller and the process for flattening the medium, where there is no waste with only necessary portions being carried out, is possible. In addition, it is possible to significantly shorten the time which is necessary for the process for flattening in a case where there are only a few locations where the process for flattening is performed on the medium and the process for flattening is performed only over a narrow area.

The liquid discharge apparatus of the fourth aspect of the present invention is the first aspect which is provided with the pressure roller which adheres the medium to the adhesive layer of the transport belt, and the control section performs controlling where the process for flattening is executed using the pressure roller by moving the transport belt in the opposite direction to the transport direction of the medium.

According to the present aspect, it is possible to realize the same actions, as when the pressure roller is moved in the transport direction of the medium, with the operation where the transport belt is moved in the opposite direction to the transport direction of the medium. Then, according to the present aspect, it is possible to provide the liquid discharge apparatus with a simplified structure, with few components, and at a low cost since it is possible to configure the flattening section using the preexisting driving means which drives the transport belt and the preexisting pressure roller where the medium is adhered to the adhesive layer of the transport belt.

The liquid discharge apparatus of the fifth aspect of the present invention is any one of the first aspect to the fourth aspect where the liquid discharge section has a structure so as to be moved back and forth in the width direction which intersects with the transport direction of the medium, and the control section performs controlling where the process for flattening is executed using the flattening section in a state where the liquid discharge section is moved to a retreat position so as to not impede operations of the flattening section when floating in the medium is detected by the sensor.

According to the present aspect, there is no restriction of the process for flattening due to the liquid discharge section when operating the flattening section in order to eliminate floating in the medium.

The liquid discharge apparatus of the sixth aspect of the present invention is the fifth aspect where the control section performs controlling where the liquid discharge section retreats to above a side edge in the width direction of the transport belt where there is no medium on the transport belt and a flushing operation is carried out at the retreat position.

According to the present aspect, it is possible to shorten the distance for the liquid discharge section to move to the retreat position which is executed prior to the process for flattening being performed. Due to this, it is possible to restart liquid discharge by the liquid discharge section being quickly returned to a liquid discharge start position after the process for flattening is executed.

In addition, it is possible to efficiently perform the flushing operation since flushing of the liquid discharge section is performed during the process for flattening.

The liquid discharge apparatus of the seventh aspect of the present invention is the fifth aspect or the sixth aspect where the control section performs controlling where a part, where floating is generated in the medium, passes through the liquid discharge region using the liquid discharge section in a state where the liquid discharge section is moved to the retreat position in a case where floating in the medium is not eliminated by the flattening section.

According to the present aspect, it is possible to restart liquid discharge with regard to the medium from a location where there is no floating even in a case where eliminating of floating is difficult since the part where floating is generated in the medium passes through the liquid discharge region using the liquid discharge section in a case where floating in the medium is not eliminated using the flattening section.

The liquid discharge apparatus of the eighth aspect of the present invention is any one of the first aspect to the seventh aspect where the control section performs controlling where liquid discharge with regard to the medium is temporarily stopped during executing of the process for flattening using the flattening section and liquid discharge with regard to the medium is restarted after executing of the process for flattening using the flattening section.

According to the present aspect, it is possible to precisely execute each of the processes without the processes being influenced by each other by separating the process for flattening the medium and the process for executing liquid discharge with regard to the medium.

The liquid discharge apparatus of the ninth aspect of the present invention is any one of the first aspect to the seventh aspect where the control section performs controlling where the process for flattening with regard to the medium using the flattening section and liquid discharge with regard to the medium are executed in parallel.

According to the present aspect, it is possible to continuously execute liquid discharge while performing the process for flattening where floating in the medium is eliminated without temporarily stopping executing of liquid discharge even in a case where floating is generated in the medium.

A medium flattening method according to the tenth aspect of the present invention, when the medium is transported by being adhered to the adhesive layer which is on a surface of the transport belt, includes detecting the presence or absence of floating being generated in the medium on the transport belt using the sensor, executing a process for flattening where floating in the medium is flattened in the case where there is floating, and transporting the medium, where the floating is eliminated using the process for flattening, to the liquid discharge region using the liquid discharge section.

According to the present aspect, it is possible to execute efficient liquid discharge with regard to the medium since it is possible to automatically detect and eliminate floating even when floating in the medium is not manually eliminated by temporarily stopping transporting by the transport belt in a case where floating such as curling is generated in the medium which is transported by being adhered to the transport belt. Accordingly, it is possible to continuously execute liquid discharge of a certain quality even with regard to a medium where it is easy for floating to be generated.

According to the tenth aspect of the invention, the medium flattening method further comprises controlling adjustment of a movement range of a pressure roller according to a position of the floating which is detected by the sensor, and the pressure roller is configured to adhere the medium to the adhesive layer of the transport belt and execute the process for the flattening by moving along a transport direction of the medium.

According to the tenth aspect of the invention, the executing of the process for the flattening includes flattening the floating by using a pressure roller and moving the transport belt in an opposite direction to a transport direction of the medium, and the pressure roller is configured to adhere the medium to the adhesive layer of the transport belt.

According to the tenth aspect of the invention, the executing of the process for the flattening includes flattening the floating in a state where the liquid discharge section is moved to a retreat position in a width direction which intersects with a transport direction of the medium so as to not impede the flattening when the floating in the medium is detected by the sensor.

According to the tenth aspect of the invention, the medium flattening method further comprises controlling the liquid discharge section to retreat to above a side edge in the width direction of the transport belt where no medium exists on the transport belt and controlling carrying out a flushing operation at the retreat position.

According to tenth the aspect of the invention, the medium flattening method further comprises controlling a part where the floating is generated in the medium to pass through the liquid discharge region of the liquid discharge section in a state where the liquid discharge section is moved to the retreat position in a case where the floating in the medium is not eliminated.

According to tenth the aspect of the invention, the medium flattening method further comprises temporarily stopping liquid discharge with regard to the medium during executing of the process for the flattening and restarting liquid discharge with regard to the medium after executing of the process for the flattening.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A medium flattening method when a medium is transported by being adhered to an adhesive layer which is on a surface of a transport belt, the method comprising:

detecting a presence or absence of floating being generated in the medium on the transport belt using a first sensor;

executing a process for flattening to flatten the floating in the medium in the case where the floating exists;

confirming whether or not the floating in the medium is eliminated by executing the process for the flattening using a second sensor; and transporting the medium, where the floating is eliminated using the process for the flattening, to a liquid discharge region of a liquid discharge section, the executing of the process for the flattening including executing the process for the flattening with regard to the medium and liquid discharge with regard to the medium in parallel, the process for the flattening being executed by moving a pressure roller that adheres the medium to the adhesive layer along a transport direction of the medium in an area between the first sensor and the second sensor in the transport direction.

* * * * *